United States Patent [19]

Erickson et al.

[11] 4,110,584

[45] Aug. 29, 1978

[54] LOAD BREAK SWITCH WITH TRANSPARENT INTERNAL SHIELD

[75] Inventors: John W. Erickson; James A. Erickson, both of Crystal Lake, Ill.

[73] Assignee: Boltswitch, Inc., Crystal Lake, Ill.

[21] Appl. No.: 768,167

[22] Filed: Feb. 14, 1977

Related U.S. Application Data

[63] Continuation-in-part of Ser. No. 607,352, Aug. 25, 1975, Pat. No. 4,020,432.

[51] Int. Cl.[2] ..... H01H 9/02; H01H 13/04; H01H 19/04; H01H 21/04

[52] U.S. Cl. ..... 200/304; 361/424

[58] Field of Search ..... 200/304, 305; 335/76, 335/73; 361/378, 424

[56] References Cited

U.S. PATENT DOCUMENTS

| | | | |
|---|---|---|---|
| 1,466,481 | 8/1923 | Ridgely | 200/304 |
| 2,641,636 | 6/1953 | Born et al. | 361/378 |
| 3,443,252 | 5/1969 | Spinelli et al. | 335/73 |
| 4,020,432 | 4/1977 | Erickson et al. | 335/76 |

FOREIGN PATENT DOCUMENTS

| | | | |
|---|---|---|---|
| 631,878 | 11/1961 | Canada | 200/304 |

*Primary Examiner*—Leonard D. Christian
*Attorney, Agent, or Firm*—Kinzer, Plyer, Dorn & McEachran

[57] ABSTRACT

A high current, low voltage, load-break switch of the type which is installed in a housing having an access door. The switch comprises a fixed contact, a movable contact which is movable between a closed position in bolted pressure contact with the fixed contact and an open position which is displaced from the fixed contact. A mechanism is provided for rapidly opening and closing the switch by driving the movable contact to its closed position and also to its open position. A transparent shield is supported across the front of the switch contacts to visually expose the switch contacts when the access door to the housing is open while providing protection in the event of electrical arcing and mechanical failure of the switch contacts.

3 Claims, 2 Drawing Figures

LOAD BREAK SWITCH WITH TRANSPARENT INTERNAL SHIELD

CROSS-REFERENCE TO RELATED APPLICATIONS

This application is a continuation-in-part of application Ser. No. 607,352, filed Aug. 25, 1975 now U.S. Pat. No. 4,020,432.

BACKGROUND OF THE INVENTION

This invention relates to a safety shield for a bolted-pressure contact switch and particularly to a safety shield which provides visual access to the switch contacts for determining the condition of the switch.

Fused load-break switches are frequently used as service entrance equipment and in other relatively high current applications. Typically, multiple-pole switches of this kind may be required to interrupt currents of 400 to 20,000 amperes. Most switches of this kind are provided with positive pressure-applying mechanisms for assuring good contact between the switch terminals. The contacts of these switches are opened and closed rapidly to minimize arcing and thereby avoid pitting and deterioration of the switch contacts. Rapid opening and closing of the switch contacts have been accomplished by the use of an overcenter spring drive. The spring drive can be energized and the switch actuated by manual or electrical means. The manual or electrical means is not used directly to open or close the switch contacts but, instead, operates a trip mechanism to release the spring drive. The use of electrical means such as electric motors or solenoids to actuate the switch and energize the spring drive permits remote operation of the switch but this, in turn, has increased the dangers to maintenance and repair personnel who are less likely to be aware of the actual condition of the switch contacts when they gain access to the switch housing. Opaque shields have been provided in front of the switch contacts to protect personnel against arcing but these prevent visual determination of the condition of the switch contacts.

SUMMARY OF THE INVENTION

It is an object of the present invention, therefore, to provide a safety shield for the contacts of a high current, low voltage, load-break switch which protects a workman against injury from arcing of the switch contacts but permits unimpeded visual inspection of the contacts when the door of the switch housing is open so that a determination of the actual condition of the switch contacts can be made before any repair or maintenance work is done to the switch.

A further object of the invention is to provide a transparent shield which is located inside the switch housing where it is relatively safe from mechanical injury and damage and protected against dirt and fumes which could reduce the transparency thereof.

Accordingly, the invention relates to a high current, low voltage, load-break switch of the type which is installed in a housing having an access door. The switch is of the type comprising a fixed contact and a movable contact which is movable between a closed position in bolted pressure contact with the fixed contact and an open position which is displaced from the fixed contact. Means are provided for rapidly opening and closing the switch by driving the movable contact to its closed position and to its open position. A transparent shield is supported across the front of the switch contacts and is located inside the housing so that it will provide visual access to the switch contacts when the access door to the housing is open to permit positive determination of the condition of the switch contacts yet will provide protection in the event of electrical arcing of the switch contacts.

DESCRIPTION OF THE PREFERRED EMBODIMENT

Figure 2:
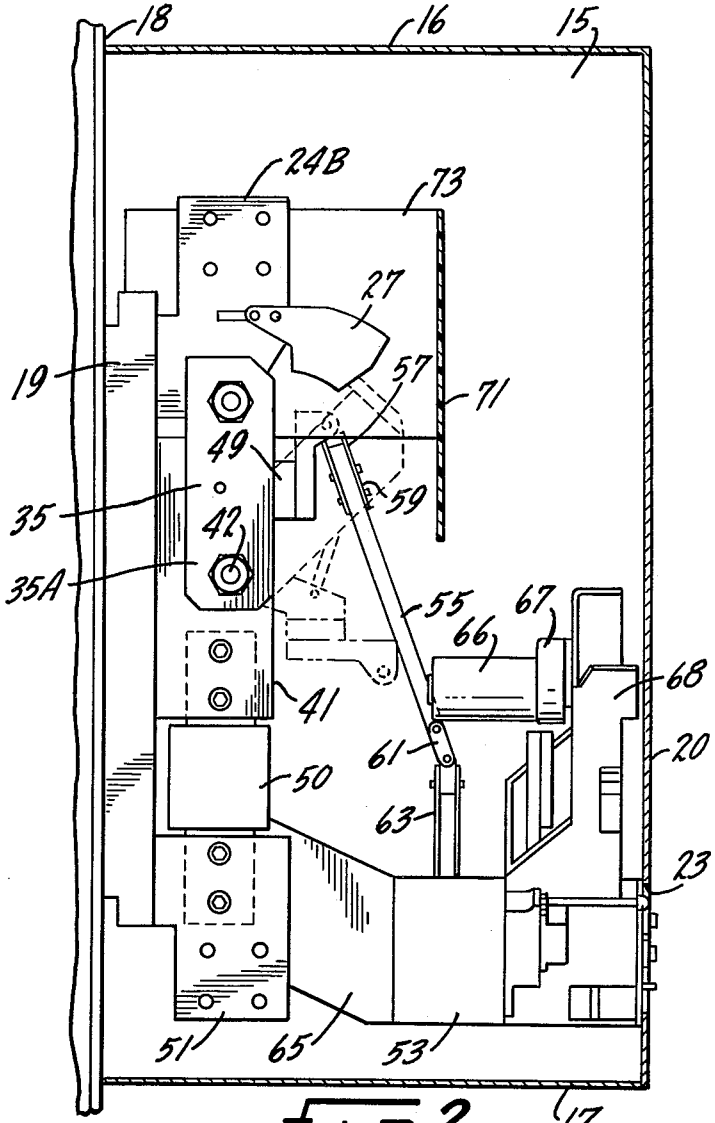
FIG. 2 is a vertical cross-sectional view taken through the switch housing and showing the open position of the switch contacts in phantom.
Figure 1:
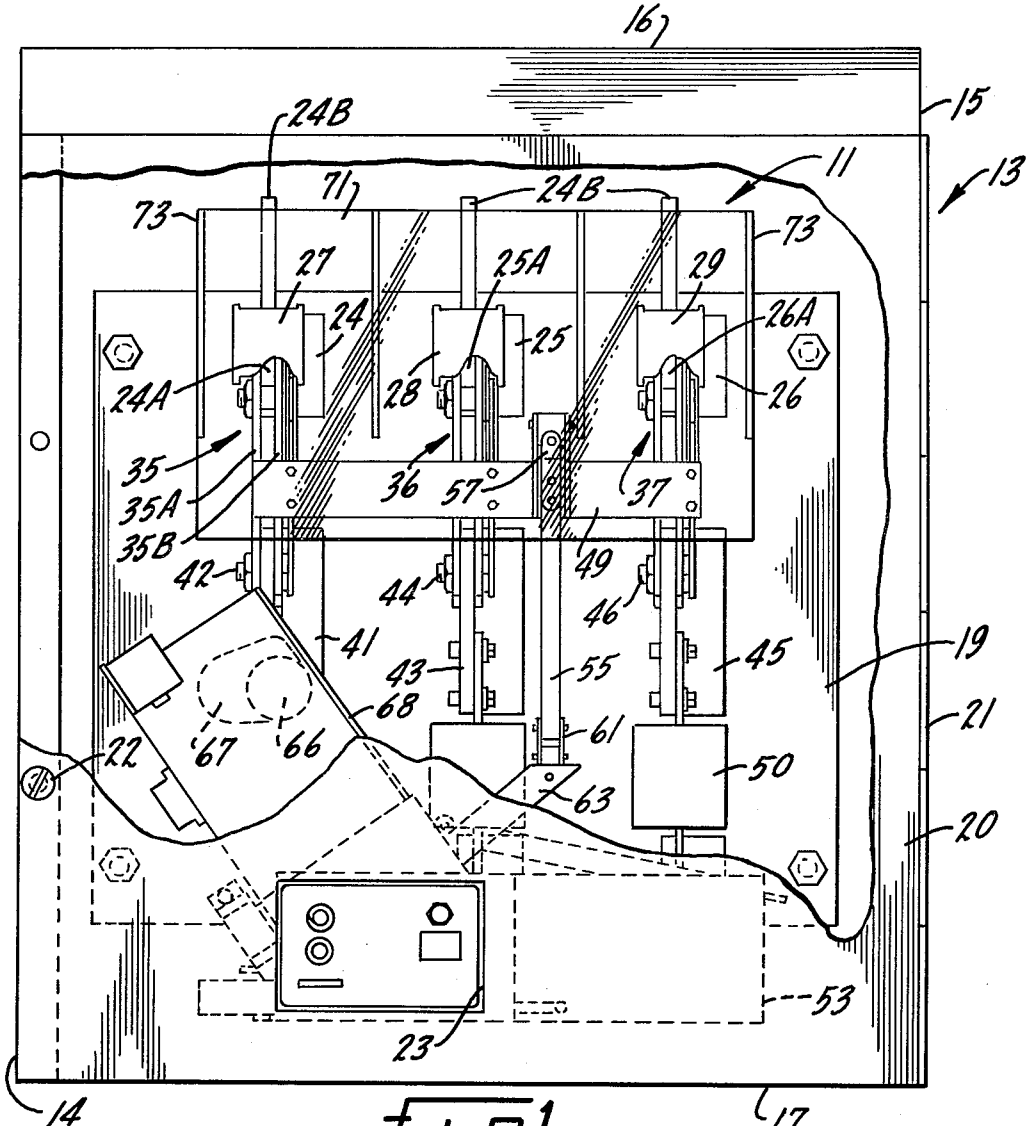
FIG. 1 is a front elevational view of a housing containing a load-break switch constructed in accordance with the present invention and in which parts of the switch housing are broken away for clarity of illustration.

FIGS. 1 and 2 illustrate a high-current, low-voltage load-break switch 11 which is installed in a metal housing 13 of conventional construction. The housing includes side walls 14 and 15, a top wall 16 and a bottom wall 17, all of which are formed conventionally of sheet metal. An incombustible frame member 18 is located at the rear of the housing. A base member 19 of insulating material on which the switch 11 is mounted is attached to the frame member 18. A door 20 located at the front of the housing is hingedly connected thereto along one vertical edge 21. The door 20 is secured in its closed position relative to the cabinet by screws 22 or other suitable fastening means. The door 20 is usually opaque and may be equipped with an opening 23 for operating buttons, target indicators, etc.

FIGS. 1 and 2 of the drawings show a load break switch 11 of known construction in its closed position. Across the top of the insulating base 19, there are mounted three fixed contacts 24, 25 and 26 provided with outwardly projecting contact blades 24A, 25A and 26A, respectively; each fixed contact may be provided with an individual terminal lug 24B, 25B and 26B, respectively. Three arc chutes 27, 28 and 29 are mounted on the fixed contacts 24, 25 and 26 respectively. A suitable arc chute is shown in U.S. Pat. No. 3,441,699, but the invention should not be limited to the use of the particular arc chute shown in that patent since that arc chute is merely illustrative of one of a number of different forms of arc chutes which may be used.

Each of the fixed contacts 24, 25 and 26 is one element of a pole of the switch 11. Contacts 24, 25 and 26 are each engageable by a movable contact 35, 36 and 37, respectively. Each movable contact comprises a pair of contact blades such as the blades 35A and 35B of movable contact 35. Movable contacts 35, 36 and 37 are pivotally mounted upon electrical connector brackets 41, 43 and 45 respectively by means of suitable pivot members 42, 44 and 46.

Switch 11 further includes an actuating bar 49 that extends transversely of the switch and is connected to each of the movable contacts 35, 36 and 37 by means of a connecting linkage, so that pivotal movement of the bar 49 with respect to the aligned pivot members drives the movable contacts of the switch to move pivotally into and out of engagement with the fixed contacts 24, 25 and 26. Switch 11 is also provided with appropriate overload fuses 50 and electrical lugs 51 to afford a means to complete electrical connections to the movable switch contacts.

Switch 11, as thus far described, corresponds in construction to the load-break, pressure-contact switch described and claimed in U.S. Pat. No. 3,213,247. The present invention is not directed to the switch structure per se, and should not be construed as limited to use with the particular load switch of U.S. Pat. No. 3,213,247 which is merely illustrative of one of a number of different forms of switches in which the invention may be incorporated. Rather, the present invention pertains to a protective transparent shield for the switch contacts. Likewise, operating mechanism 53 as shown and described corresponds in construction to the trip-free switch-operator mechanism described and claimed in U.S. Pat. No. 3,582,595. As stated in reference to the switch structure, the present invention is not directed to the switch-operator mechanism per se and should not be construed as limited to use with the particular switch-operator mechanism of U.S. Pat. No. 3,582,595.

The actuating bar 49 of switch 11 is connected to an operating rod 55 by means of a pivotal connection 57. More specifically, rod 55 has its upper end affixed to an upper yoke 59 and its lower end secured to a lower yoke 61. Lower yoke 61 is pivotally connected to an operating lever 63 that is a part of the switch-operator mechanism 53. In FIGS. 1 and 2, operating lever 63 is shown in its upper or closed-switch position. Opening of the switch 11 is effected by lever 63, which turns in a clockwise direction (FIG. 1) and pulls operating rod 55 downwardly to pivot actuating bar 49 outwardly and away from the switch base 19. The pivotal movement of bar 49 simultaneously pivots the movable contacts 35, 36 and 37 outwardly from the fixed contacts 24, 25 and 26 and thus opens the switch. The open position of the actuating bar 49 and the movable contacts is shown in phantom lines in FIG. 2.

The number of poles in the switch 11, as well as the size of the contacts of the switch, may be varied for different applications. However, for all switches of this general kind, it is essential that the contacts separate rapidly and close rapidly in order to prevent excessive arcing, which would otherwise limit the contact life quite severly.

The basic function of the switch-operator mechanism 53 is to apply the required force to rapidly open and close the switch 11. As explained above, it is actually the upward and downward angular movement of operating lever 63 which effects the closing and opening, respectively, of the switch 11.

Switch operator-mechanism 53 is fixed in positional relationship in front of switch 1 by means of a bracket 65. As disclosed in U.S. Pat. No. 3,582,595, operating lever 63 is rotatably mounted about a main drive shaft of the switch-operator mechanism 53. The switch operator-mechanism is equipped with an overcenter spring drive which is actuated when rotation of the main drive shaft is initiated in either the switch-opening or switch-closing direction. Initial rotation of the main drive shaft in the switch-opening direction is accomplished by a switch-opening energy-storage spring which is charged during the closing motion of the switch. Thus, it can be appreciated that an electrical signal from a remote location may be effective to actuate the switch-operator trip means or solenoid to initiate opening of the switch.

A mechanism for applying force to close the switch is described and claimed in U.S. patent application, Ser. No. 607,352, filed Aug. 25, 1975 now U.S. Pat. No. 4,020,432, of which this application is a continuation-in-part. The mechanism described in that patent application includes a motor assembly for automatically rotating the main drive shaft in the switch closing direction to thereby close the switch, charge the switch-opening energy-storage device and reset itself for subsequent actuations. The mechanism also includes an electric motor 66 having an integral speed reduction gear box 67 mounted on a support plate 68. The gear box has an output shaft which connects to an operating shaft by a first transmission means which includes a mutilated ratchet element operatively connected to the operating shaft. The ratchet element defines a disengaged condition for the first transmission means at a first angular orientation of the ratchet element. In addition, a second transmission means couples the operating shaft to the main drive shaft of the switch operator to rotate the main drive shaft in a direction to close the switch. To rotate the multilated gear element beyond the first angular orientation, an electrical-actuated engagement device is provided. An electrical circuit is provided for energizing the motor and engagement device, which circuit includes a sensing switch for de-energizing the motor and the engagement device at a second angular orientation of the ratchet element.

Although the transparent protective shield of the present invention is shown in conjunction with the particular motor assembly of U.S. patent application Ser. No. 607,352, filed Aug. 25, 1975 now U.S. Pat. No. 4,020,432, it is not, nor is it intended to be limited to use exclusively with this particular motor assembly. The transparent protective shield of this invention may also be used with the combination motor or manual operated switch mechanism shown and claimed in U.S. Pat. No. 3,522,401 as well as with any other bolted pressure contact switch which is actuated either manually or electrically.

A transparent shield 71 is positioned in front of the switch contacts and is supported in this position on metal shields or partitions 73 which are located between and on the sides of the switch contacts 35, 36 and 37. The transparent shield extends downwardly to a level below the closed position of the switch actuating bar 49. The transparent shield is located inside the metal housing 13 where it is protected against mechanical injury and damage and is also relatively protected against dirt and fumes which could reduce the transparency thereof. When a maintenance man or repairman opens the door 20 of the metal housing to perform maintenance or repair work on the switch 11, he can immediately see and determine the condition of the switch contacts. For example, if the switch was supposed to be open but has remained closed due to a malfunction of the switch operator, the repairman can immediately see that the switch contacts are not open. Therefore, he will be able to correct the condition causing the malfunction and open the switch contacts before he removes a fuse or performs service work on the circuit beyond the switch.

The transparent shield 71 also provides the repairman with protection in the event that one or more switch contacts remain engaged, however slightly, due to a malfunction of the switch mechanism. This may occur though the remote control and other indicators show that the switch is open. The transparent shield also functions in the event that the contacts are hung up in an arcing position. Without a shield, a maintenance or repairman could be injured upon opening the door 20 while the contacts are arcing. While conventional opaque shields provided protection against injury caused by arcing, such shields also prevented the maintenance or repairman from readily determining the true condition of the switch contacts, and thus exposed him to other and equally severe dangers.

Whereas the preferred form of the invention has been described herein, it should be realized that there may be modifications, substitutions and alterations thereto all within the spirit and broad scope of the appended claims.

We claim:

1. In a high-current, low-voltage load-break switch of the type which is installed in a housing having an access door, said switch comprising a fixed contact, a movable contact movable between a closed position in bolted pressure contact with the fixed contact and an open position displaced from the fixed contact, and means for rapidly opening and closing the switch by driving the movable contact to its closed position and to its open position, and a transparent shield supported in a fixed position across the front of the switch contacts in both their open and closed positions to visually expose the switch contacts when the access door to the housing is open while providing protection in the event of electrical arcing and mechanical failure of the switch contacts.

2. The switch of claim 1 in which said transparent shield is positioned a sufficient distance in front of the fixed contact that it does not interfere with the movement of the movable contact between its open and closed positions.

3. The switch of claim 1 in which said switch includes a plurality of pairs of fixed and movable contacts, partitions are located between said contacts, said partitions extend to and support said transparent shield.

* * * * *